US006122475A

United States Patent [19]

Seto et al.

[11] Patent Number: 6,122,475

[45] Date of Patent: Sep. 19, 2000

[54] IMAGE FORMING APPARATUS WITH AN INTERMEDIATE TRANSFER ELEMENT HAVING A POLARITY CONTROLLING MATERIAL

[75] Inventors: Mitsuru Seto, Kanagawa-ken; Naoko Iwata, Tokyo; Naoki Sugiyama, Yokohama, all of Japan

[73] Assignee: Ricoh Company, Ltd., Tokyo, Japan

[21] Appl. No.: 09/240,871

[22] Filed: Feb. 1, 1999

[30] Foreign Application Priority Data

Jan. 30, 1998 [JP] Japan ..... 10-032339
Dec. 21, 1998 [JP] Japan ..... 10-375874

[51] Int. Cl.[7] ..... G03G 15/16

[52] U.S. Cl. ..... 399/308; 399/302

[58] Field of Search ..... 399/297, 302, 399/308

[56] References Cited

U.S. PATENT DOCUMENTS 5,510,886 4/1996 Sugimoto et al. ..... 399/308
5,761,594 6/1998 Seto et al. ..... 399/302
5,887,218 3/1999 Yuu et al. ..... 399/302 X

*Primary Examiner*—Fred L. Braun
*Attorney, Agent, or Firm*—Oblon, Spivak, McClelland, Maier & Neustadt, P.C.

[57] ABSTRACT

An image forming apparatus includes an image carrier, an intermediate transfer element to transfer a developed image, an electrode to apply a bias having preselected polarity to the intermediate transfer element and form an electric field. The intermediate transfer element has an adhering force acting on toner of the developed image that is greater than or equal to an adhering force acting between the toner and the image carrier, and when a frictional charging polarity of the toner which rubs against the intermediate transfer element is the same polarity as the bias applied to the intermediate transfer element from the electrode.

10 Claims, 6 Drawing Sheets

IMAGE FORMING APPARATUS WITH AN INTERMEDIATE TRANSFER ELEMENT HAVING A POLARITY CONTROLLING MATERIAL

CROSS-REFERENCE TO RELATED APPLICATIONS

This application contains subject matter related to that disclosed in U.S. Pat. No. 5,761,594 filed on Nov. 14, 1995 entitled "Image Forming Apparatus", and co-pending application Ser. No. 09/033,643 filed on Mar. 3, 1998 entitled "Image Forming Apparatus", each having common inventorship, and the contents of each of which being incorporated herein by reference.

BACKGROUND OF THE INVENTION

1. Field of the Invention

The present invention relates to a transfer system and machine that incorporates the transfer system that transfers an image forming substance from one surface to another surface. More particularly, the invention relates to copying machines, facsimile machines, printer machines and similar image forming apparatuses that include an intermediate transfer element for transferring an image, and in particular, a color image as part of an image forming process.

2. Discussion of the Background

In conventional color image forming apparatuses, a plurality of color toner images are sequentially formed on an image carrier (e.g., a photoconductive element) while being sequentially transferred to the intermediate transfer element one on top of the other (primary transfer). The resulting composite image on the intermediate transfer element is transferred to a sheet or similar transfer medium at a single time (secondary transfer). Such intermediate transfer systems are used in conventional color image forming apparatuses (e.g., a full-color image forming apparatus which reproduces color-separated document images on the basis of using black, cyan, magenta and yellow colored-toner).

In such an image forming apparatus, it is possible that the transfer of toner may fail in certain localities of the image, at the primary and secondary transfer stages. As a result, a full-color image transferred to the sheet or similar transfer medium may be locally lost, or omitted in spots. The local omission of an image occurs with some areas when the image has a substantial area, or occurs as breaks in the case of a line image. In order to address the local omission of an image (i.e., enhancing the transfer ability), various technologies have been proposed in the past and may generally be classified into five groups, as follows.

[I] Reducing Surface Roughness of Intermediate Element (a) The intermediate element is formed of an elastomer and provided with a particular surface roughness, as disclosed in Japanese Patent Laid-Open Publication No. 3-242667 by way of example. This scheme enhances the close contact of the intermediate element and transfer medium and thereby improves the transferability of toner.

(b) The intermediate element is provided with a particular surface roughness to improve toner transferability, as described in, e.g., Japanese Patent Laid-Open Publication Nos. 63-194272, 4-303869, 4-303872, and 5-193020.

[II] Setting Linear Velocities of Transfer Members

The transfer members are each provided with a particular linear velocity in order to improve the transferability, as described in e.g., Japanese Patent Laid-Open Publication No. 2-213882.

[III] Reducing Pressure at Nip

A nip for image transfer is provided with a particular pressure for improving the transferability, as described in, e.g., Japanese Patent Laid-Open Publication Nos. 1-177063 and 45-284479.

[IV] Reducing Surface Energy of Intermediate Element (a) The intermediate element is provided with a small degree of wettability in order to enhance the transferability, as disclosed in Japanese Patent Laid-Open Publication Nos. 2-198476 and 2-212867, for example.

(b) The intermediate element has a laminate structure and has the outermost layer formed of a material having a high parting ability, as shown and described in, e.g., Japanese Patent Laid-Open Publication Nos. 62-293270, 5-204255, 5-204257, and 5-303293.

(c) A substance having a high parting ability is fed to the intermediate element in order to enhance the transferability, as disclosed in, e.g., Japanese Laid-Open Publication No. 58-187968.

[V] Removing Toner Film from Intermediate Element

As described in, e.g., Japanese Patent Laid-Open Publication Nos. 5-273893, 5-307344, -313526, and 5-323802, the surface of the intermediate element suffered from toner filming so the surface was ground and refreshed to enhance the transferability.

The local omission of an image at the secondary transfer stage often occurs when using a roller as a secondary transfer mechanism for the following two reasons.

(a) In the case of a full-color image, the toner layer has a substantial thickness. In addition, an intense mechanical adhering force, which is a non-Coulomb's force acting between the intermediate element and the toner, is generated due to the contact pressure attributable to the roller.

(b) When an image forming process is repeated, the toner forms a film on the intermediate element. This toner filming causes an adhering force to act between the intermediate element and the toner. In order to address the above problem, U.S. Pat. No. 5,053,827 entitled "METHOD AND APPARATUS FOR INTERMITTENT CONDITIONING OF A TRANSFER BELT" discloses a conditioning process using a conditioning roller. The contents of U.S. Pat. No. 5,053,827 being incorporated herein by reference.

The conventional schemes [I]–[V] have been proposed independently of each other as measures for enhancing the transferability of toner. Some of the combinations of these schemes are effective while the others are not effective, as determined by experiments.

As to the surface energy of the intermediate belt, a series of extended research and experiments showed that presuming various possible cases, it is extremely difficult to detect the excessive rise of the surface energy in terms of a preselected number of copies.

The technology disclosed in U.S. Pat. No. 5,761,594 entitled "IMAGE FORMING APPARATUS" was introduced to address the above problem (the local omission of the toner image transferred to the intermediate transfer element). Here, the intermediate transfer element has an adhering force acting on toner of a developed image that is greater than or equal to an adhering force acting between the toner and the image carrier.

Further, as a result of subsequent extended experiments and research, it was found by experiments that the toner image may be improperly transferred from the image carrier to the intermediate transfer element under a specific condition even if the above relation between the intermediate transfer element and the image carrier is satisfied. Furthermore, it is possible that the transfer of the toner may locally fail toward the middle portion of a line image when the width of the line image is extremely fine.

SUMMARY OF THE INVENTION

The present invention has been made in view of the above-described, and other, problems and addresses these problems and other deficiencies in conventional devices.

Accordingly, it is an object of the present invention to provide a novel transfer system having a stable image transferring capability, particularly, for transferring a portion of a fine line image. To this end, an image forming apparatus includes an image carrier, an intermediate transfer element to transfer a developed image, an electrode to apply a bias having a preselected polarity to the intermediate transfer element and form an electric field. The intermediate transfer element has an adhering force acting on toner of the developed image that is greater than or equal to an adhering force acting between the toner and the image carrier, and when a frictional charging polarity of the toner which rubs against the intermediate transfer element is the same polarity as the bias applied to the intermediate transfer element from the electrode.

BRIEF DESCRIPTION OF THE DRAWINGS

Many of the features and advantages of the present invention will become more apparent from the following detailed discussion when read in conjunction with the accompanying drawings in which.

DESCRIPTION OF THE PREFERRED EMBODIMENTS

Figure 1:
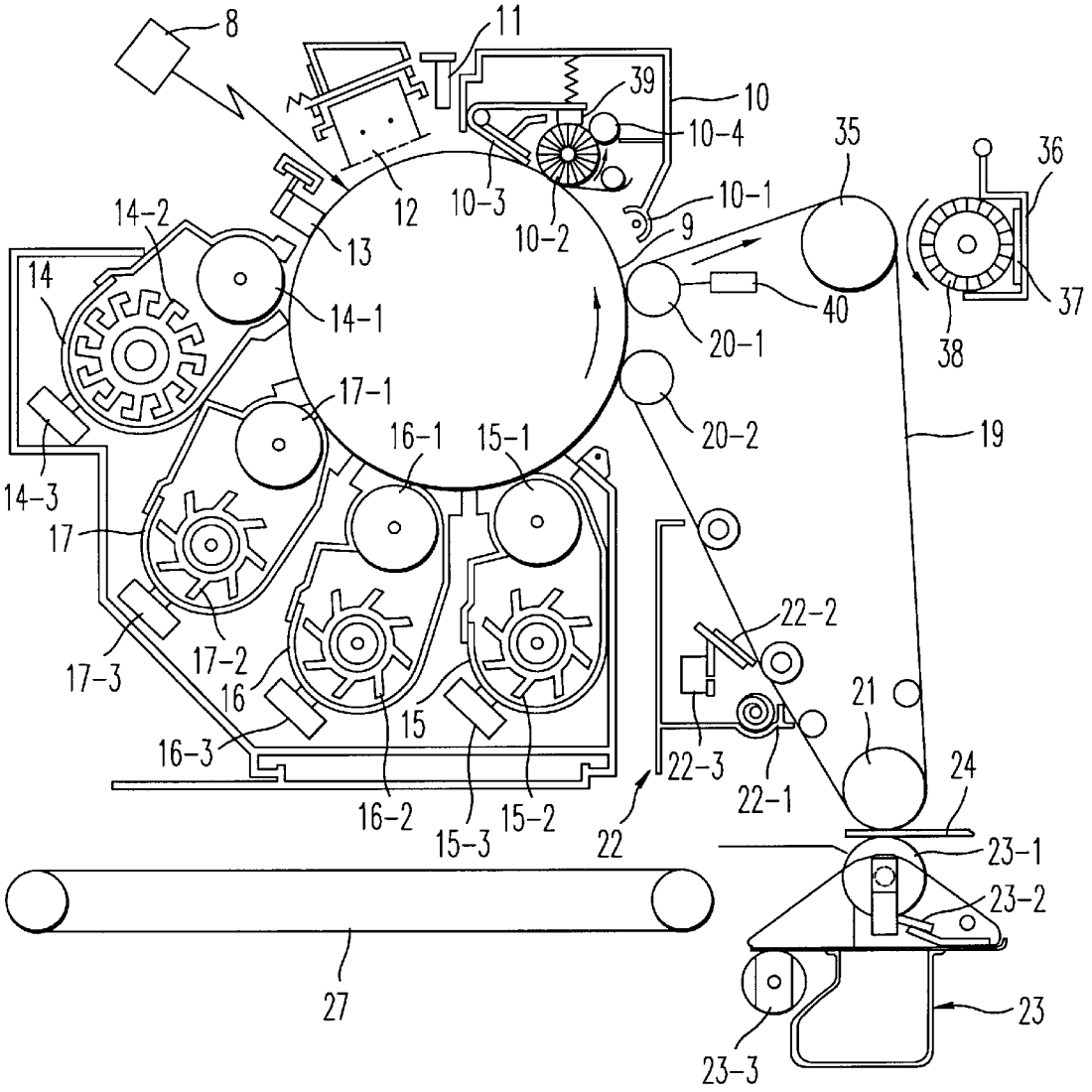
FIG. 1 is a fragmentary section of an image forming apparatus to which the present invention is applied and implemented as a color copier.

The present invention is explained in detail hereinafter using like reference numerals for identical or corresponding parts, throughout the several views.

FIG. 1 describes a construction of a color copier according to the present invention. A drum 9 is rotated counterclockwise, as indicated by an arrow in the figure. The color copier has an image carrier (e.g., a photoconductive drum 9, or other device such as a photoconductive belt). Arranged around the drum 9 are a drum cleaning unit 10 (including a precleaning discharger), a discharge lamp 11, a charger 12, a potential sensor 13, a Bk (black) developing unit 14, a C (cyan) developing unit 15, an M (magenta) developing unit 16, a Y (yellow) developing unit 17, a density pattern sensor 18, and an intermediate transfer element 19 (e.g., a belt). The belt 19 is passed over electrodes 20 (e.g., a transfer roller 20-1, a support roller 20-2, or other structures such as a brush, blade or the like), a drive roller 21, and a plurality of driven rollers.

A power source 40 applies a primary transfer bias voltage (negative polarity) to the transfer roller 20-1. The belt 19 is pressed against the drum 9 via the transfer roller 20-1, and adequate degree of pressure acts at the nip between the belt 19 and the drum 9. A motor, not shown, is drivably connected to the drive roller 21.

A belt cleaning unit 22 has a brush roller 22-1, a rubber blade 22-2, and a mechanism 22-3 for moving the unit 22 into and out of contact with the belt 19. During the primary transfer of the C, M and Y toner images to the belt 19, the mechanism 22-3 maintains a separation between the cleaning unit 22 and the belt 19. A paper transfer unit 23 administers a secondary transfer of the full-color image, and includes a transfer roller 23-1, a roller cleaning blade 23-2, and a mechanism 23-3 for moving the transfer roller 23-1 into and out of contact with the belt 19. Usually, the mechanism 23-3 maintains the cleaning blade 23-2 spaced from the belt 19. In the event when the full-color image is transferred from the belt 19 to the paper 24, the mechanism 23-3 presses the transfer roller 23-1 against the belt 19. At the same time, a preselected bias voltage is applied to the transfer roller 23-1.

An image forming operation using the above described components will be described hereinafter. The charger 12 charges the surface of the drum 9. The optical writing unit 8 sequentially writes images on the drum 9 in accordance with image data each being representative of an image of particular color. Developing units 14–17 each develops a latent image of particular color electrostatically formed on the drum 9 by the optical writing unit 8. An electric field formed by a transfer bias (negative polarity) from the transfer roller 20 sequentially transfers toner images sequentially formed on the drum 9 by the developing units 14–17 to the intermediate transfer belt 19 one on the other (a primary transfer), in a superimposed fashion. A feed roller (not shown) feeds a sheet 24 to a registration roller (not shown), which drives the sheet 24 according to a predetermined timing sequence such that the leading edge of the sheet 24 meets the leading edge of the image carried on the belt 19. As a result, the image is transferred from the belt 19 to the sheet 24 at the nip between the drive roller 21 and the transfer roller 23-1 (secondary transfer). The sheet 24 carrying the image thereon is conveyed to a fixing unit by a belt 27 so that the fixing unit may fix the toner image on the sheet 24.

A preferred embodiment of the present invention is implemented under the following conditions:

Material for drum 9:
- OPC (Organic Photo Conductor)

Electrical Characteristics for Belt 19:
- Ps (surface resistivity)=$5\times10^{8}$ Ω/□cm~$5\times10^{9}$ Ω/□cm,
- Pv (volume resistivity)=$5\times10^{11}$ Ωcm~$5\times10^{12}$ Ωcm (JIS, Japanese Industrial Standards, K6911).

Transfer roller 23-1 characteristics:
- hydrine rubber roller covered with PEE tube Pn=$10^{9}$ Ωcm (JISK6911)(main resin) colored by carbon for black or pigments for magenta and yellow; silica added to outer periphery Developer:
- toner concentration of 4 to 6 wt % for each color, charge of −25 to −15 μC/g for each color Drum potential:
- −80 to −130 V for image portion or −500 to −700 V for background An omission of the middle portion of a fine line image (a so-called a fine line hollow) will be described hereinafter.

EXPERIMENT 1

Figure 2:
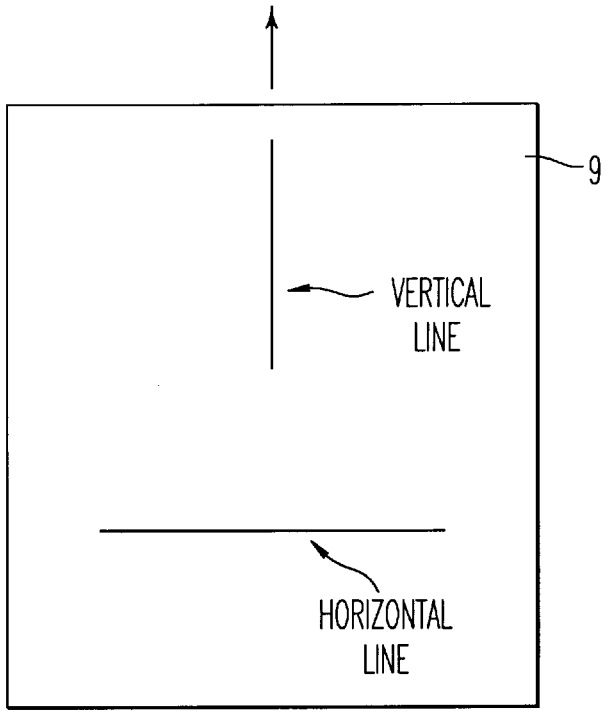
FIG. 2 is a schematic illustration showing an arrangement for measuring an omission of a fine line image.
Figure 3:
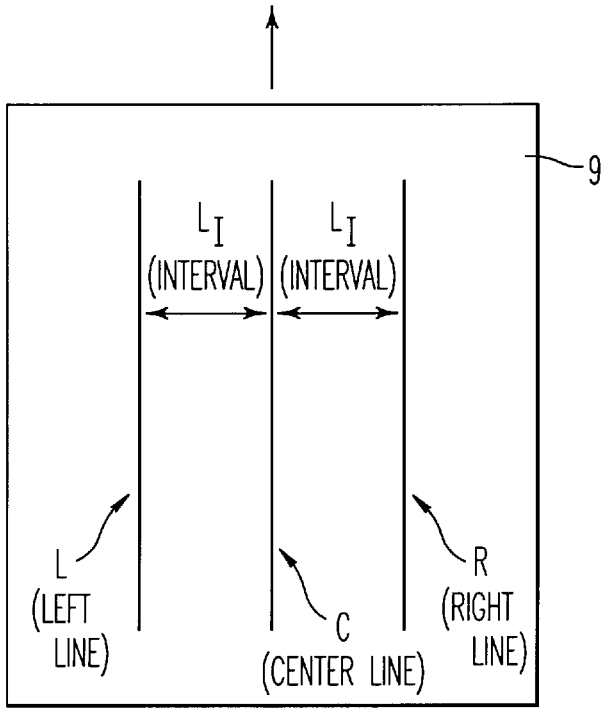
FIG. 3 is a schematic illustration showing another arrangement for measuring the omission of the fine line image.

A relation between a width of the line image and the fine line hollow was determined experimentally. Specifically, there were prepared four different line image samples having widths that were respectively measured to be 0.84 mm, 0.5 mm, 0.3 mm and 0.16 mm. With reference to FIG. 2, the line images were formed as vertical and horizontal lines on the drum 9 with respect to the moving direction of the drum 9 (as indicated by an arrow in FIG. 2) for each of the samples.

Experiments were conducted to determine conditions under which the fine line hollow occurs, and conditions for obviating it, discussed as follows.

Condition 1: an adhering force acting between the toner and the intermediate transfer belt 19 is greater than or equal to an adhering force acting between the toner and the photoconductive drum 9 in the actual operating conditions.

Condition 2: ratio of linear speed drum 9 to the belt 19 being $(V_F)/(V_B)$ being 1.002 and belt 19 to sheet 24 ratio $(V_B)/(V_P)$ being 0.91.

Condition 3: belt 19 surface roughness ranging from 0.6 to 0.9 (10-point mean roughness as prescribed by JIS B0601)

Condition 4: nip pressure between drum 9 and belt 19 being 125 g/cm$^2$, and between belt 19 and sheet 24 being 250 g/cm$^2$.

Condition 5: drum of PRETER 550 (a trade name of photoconductor, available from Ricoh Corp., and with zinc stearate applied as a lubricant).

Condition 6: developer TYPE E (a trade name of developer available from Ricoh Corp.).

For the experiments, use was made of an intermediate transfer belt, which was a seamless belt produced by the extrusion of polyvinylidene fluoride (PVdF), and having a front layer made of a silicone-contained polymer material. The copier shown in FIG. 1 was operated to produce images under the above conditions 1–6 so as to determine the fine line hollow on the intermediate transfer belt 19. One color toner formed the fine lines. The results of such experiments are listed in Table 1 below.

TABLE 1

$W_D$ is the width of the line image in mm.

| $W_D$ (mm) | 0.84 | 0.50 | 0.30 | 0.16 |
|---|---|---|---|---|
| Vertical line | Rank 5 | Rank 3 | Rank 1 | Rank 1 |
| Horizontal line | Rank 5 | Rank 5 | Rank 5 | Rank 5 |

Figure 4A:
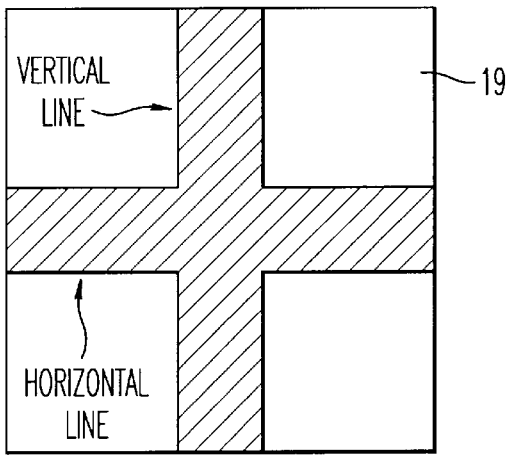
FIGS. 4(A), (B), (C), (D) and (E) are specific illustrations showing fine line images locally omitted.

In Table 1, ranks 5–1 are representative of the following conditions:

Rank 5: no local omission (FIG. 4A)

Figure 4B:
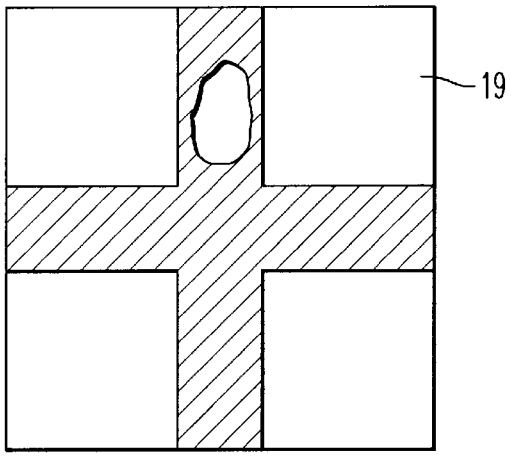

Rank 4: local omission although not visible, acceptable in about more than 80% (FIG. 4B)

Figure 4C:
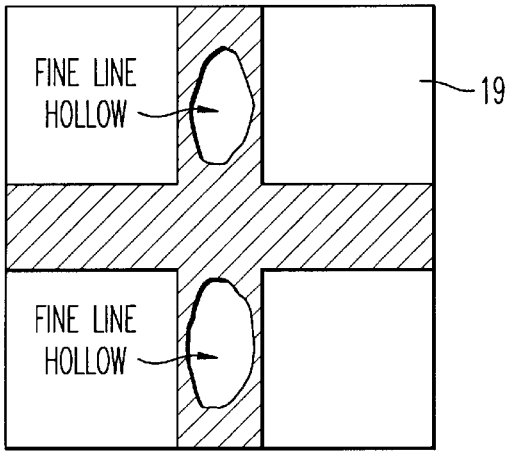

Rank 3: visible local omission, acceptable in about 50% (FIG. 4C)

Figure 4D:
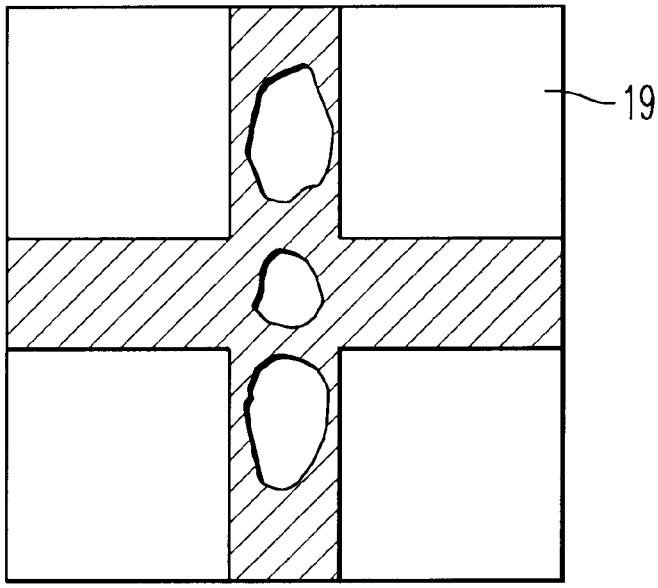

Rank 2: visible local omission, acceptable in about 20% (FIG. 4D)

Figure 4E:
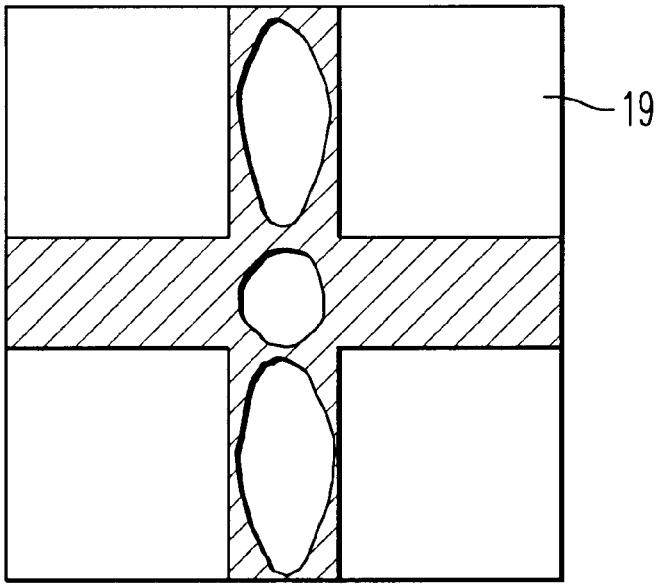

Rank 1: visible local omission, not acceptable at all (FIG. 4E)

Rank 3 and below are considered to be defective; rank 4 and above are the targets. FIG. 4 shows the fine line hollow of Rank 3 on the vertical line.

As Table 1 indicates, the fine line hollow is apt to occur when the vertical line that is formed on the photoconductive drum by an optical writing device is 0.5 mm in width or less. Particularly, the fine line hollow is more apt to occur when the width of the vertical lines is 0.3 mm or less. Further, the fine line hollow does not occur on the horizontal line.

EXPERIMENT 2

A relation between an interval of the line images and the fine line hollow was determined experimentally. Specifically, there were prepared 5 sets of three vertical line images, each having a line width measured to be 0.25 mm. Intervals between the respective lines for the five sets was measured to be 5 mm, 2 mm, 1 mm, 0.7 mm and 0.6 mm. FIG. 2 shows the vertical line images that were formed on the drum 9.

The copier shown in FIG. 1 was operated to produce images according to the above conditions 1–6 (EXPERIMENT 1) so as to determine the fine line hollow on the intermediate transfer belt 19. The results of such experiments are listed in Table 2 below.

TABLE 2

$L_I$ is the interval between the line images.
L is the left-line, C is the center-line and R is the right-line

| | $L_I$ (mm) | | | | | | | | | | | | | | |
|---|---|---|---|---|---|---|---|---|---|---|---|---|---|---|---|
| | 5 mm | | | 2 mm | | | 1 mm | | | 0.7 mm | | | 0.5 mm | | |
| Line | L | C | R | L | C | R | L | C | R | L | C | R | L | C | R |
| Rank | 2 | 2 | 1 | 3 | 5 | 2 | 3 | 5 | 1 | 2 | 5 | 2 | 2 | 5 | 2 |

In Table 2, ranks 5–1 are the same as Table 1.

As Table 2 indicates, even if the width of the lines is 0.5 mm or less, the fine line hollow does not occur on the center-line when the center-line lies between left and right-line at intervals of 2 mm or less. However, the fine line hollow is apt to occur on the left and right fine lines, regardless of line interval spacing.

Provided that, under the same conditions of above EXPERIMENT 2, the local omission of the toner image transferred to the intermediate transfer belt does not occur with some areas when the toner image has a substantial area (i.e., not merely a narrow line).

EXPERIMENT 3

A relation between a width of the line image and the fine line hollow was determined experimentally. Conditions of the experiments were the same as above for EXPERIMENT 1 except for the material used for the intermediate transfer belt 19, which was made of ethylene-tetrafluoroethylene copolymer (ETFE). The results of such experiments are listed in Table 3 below.

TABLE 3

| $W_D$ is the width of the line image. | | | | |
|---|---|---|---|---|
| $W_D$ (mm) | 0.84 | 0.50 | 0.30 | 0.16 |
| Vertical line | Rank 5 | Rank 5 | Rank 5 | Rank 5 |
| Horizontal line | Rank 5 | Rank 5 | Rank 5 | Rank 5 |

In Table 3, ranks 5–1 are the same as for Table 1.

As Table 3 indicates, the fine line hollow does not occur, irrespective of the width of the line.

EXPERIMENT 4

A relation between an interval of the line images and the fine line hollow was determined experimentally. Conditions for the experiments were the same above EXPERIMENT 2, except for a material used for the intermediate transfer belt 19, which was made of ethylene-tetrafluoroethylene copolymer (ETFE). The results of such experiments are listed in Table 4 below.

TABLE 4

| | $L_I$ (mm) | | | | | | | | | | | | | | |
|---|---|---|---|---|---|---|---|---|---|---|---|---|---|---|---|
| | 5 mm | | | 2 mm | | | 1 mm | | | 0.7 mm | | | 0.5 mm | | |
| Line | L | C | R | L | C | R | L | C | R | L | C | R | L | C | R |
| Rank | 5 | 5 | 5 | 5 | 5 | 5 | 5 | 5 | 5 | 5 | 5 | 5 | 5 | 5 | 5 |

In Table 4, ranks 5–1 are the same as for Table 1. As Table 4 indicates, the fine line hollow does not occur, irrespective of interval of the lines.

EXPERIMENT 5

A relation between a width of the line image and the fine line hollow was determined experimentally. Conditions for the experiments were the same as above for EXPERIMENT 1, except for the material used for the intermediate transfer belt 19, which was made of polycarbonate (PC). The results of such experiments are listed in Table 5 below.

TABLE 5

| $W_D$ is the width of the line image. | | | | |
|---|---|---|---|---|
| $W_D$ (mm) | 0.84 | 0.50 | 0.30 | 0.16 |
| Vertical line | Rank 4 | Rank 3 | Rank 2 | Rank 2 |
| Horizontal line | Rank 5 | Rank 5 | Rank 5 | Rank 5 |

In Table 5, ranks 5–1 are the same above Table 1. The results appear to be indifferent to the width of a horizontal line image, while the results tend to be less extreme for the vertical line than was the case for EXPERIMENT 1.

EXPERIMENT 6

A relation between an interval of the line images and the fine line hollow was determined experimentally. Conditions for the experiments were the same as for EXPERIMENT 2 except for the material used for the intermediate transfer belt 19, which was made of polycarbonate (PC). The results of such experiments are listed in Table 6 below.

TABLE 6

| | $L_I$(mm) | | | | | | | | | | | | | | |
|---|---|---|---|---|---|---|---|---|---|---|---|---|---|---|---|
| | 5 mm | | | 2 mm | | | 1 mm | | | 0.7 mm | | | 0.5 mm | | |
| Line | L | C | R | L | C | R | L | C | R | L | C | R | L | C | R |
| Rank | 2 | 2 | 2 | 2 | 2 | 1 | 2 | 2 | 2 | 2 | 3 | 2 | 2 | 3 | 2 |

In Table 6, ranks 5–1 are the same above Table 1.

As Tables 5 and 6 indicate, EXPERIMENTS 5 and 6 using belt 19 made of polycarbonate depend on the width of the line image. However, EXPERIMENTS 5 and 6 using belt 19 made of polycarbonate show a dependency on the width of the line image, but the dependency appears to be lower than that found for EXPERIMENT 1 where the belt 19 was made of polyvinylidene fluoride (PVdF), and having a front layer made of a silicone-contained polymer material.

Further, under the same conditions of above EXPERIMENTS 5 and 6, the local omission of the toner image transferred to the intermediate transfer belt occurs with some areas when the toner image has a substantial area.

Results of EXPERIMENTS 1 to 6 suggest that when an allowable level of local omission of the toner image exists for some areas (i.e., image areas that are much larger than a narrow line), the fine line hollow is apt to occur. Accordingly, addressing the occurrence of the fine line hollow requires first restraining the local omission of the toner image at some areas. However, EXPERIMENTS 1 to 6 indicate, even if an allowable level of the toner image omission occurs in some areas for a large image, transferred to the intermediate transfer belt at some areas almost completely remains, the fine line hollow may occur under a specific condition. Namely, the surface material of the intermediate transfer belt has an influence on the occurrence of the fine line hollow while addressing the local omission of the toner image. The present experimental evidence indicates that the existence of a difference in frictional charging characteristic between silicone-contained polymer and ethylene-tetrafluoroethylene copolymer (ETFE) based on a characteristic material effects the occurrence of a fine line hollow. Accordingly, in light of this discovery, additional experiments were performed to further characterize the effect of the frictional charging characteristic of a material on the occurrence rate of fine line hollows.

EXPERIMENT 7

A relation between the frictional charging characteristic of the intermediate transfer belt and the fine line hollow was determined experimentally. Specifically, there were prepared six different samples having surface materials of the intermediate transfer belt whose the frictional charging characteristic were respectively measured to be −20.3 μC/g (material A), −12.3 μC/g (material B), −8.4 μC/g (material C), −3.1 μC/g (material D), +4.2 μC/g (material E) and +8.6 μC/g (material F).

For the above experiments, intermediate transfer belts were used which were seamless belts produced by the extrusion of polyvinylidene fluoride (PVdF) and having a resistance ranging from $5\times10^{11}$ Ω cm to $5\times10^{12}$ Ω cm (JIS K6911). Coating liquids were prepared by dispersing carbon in each of the resins (material A, B. C, D, E and F) and were each applied to one of the seamless belts by spraying so as to form a 1 μm film when dried.

The copier shown in FIG. 1 was operated to produce the vertical line images, each having a width of 0.25 mm, under the conditions 1–6 of EXPERIMENT 1 so as to determine the amount of fine line hollow on the intermediate transfer belt 19.

For the measurement of the adhering force, a centrifugal force method was used, as taught in. e.g., the Journal of Electrophotographic Engineers of Japan, Vol. 34, No. 2, page 84. This method will be described hereinafter with reference to FIG. 5.

Figure 5:
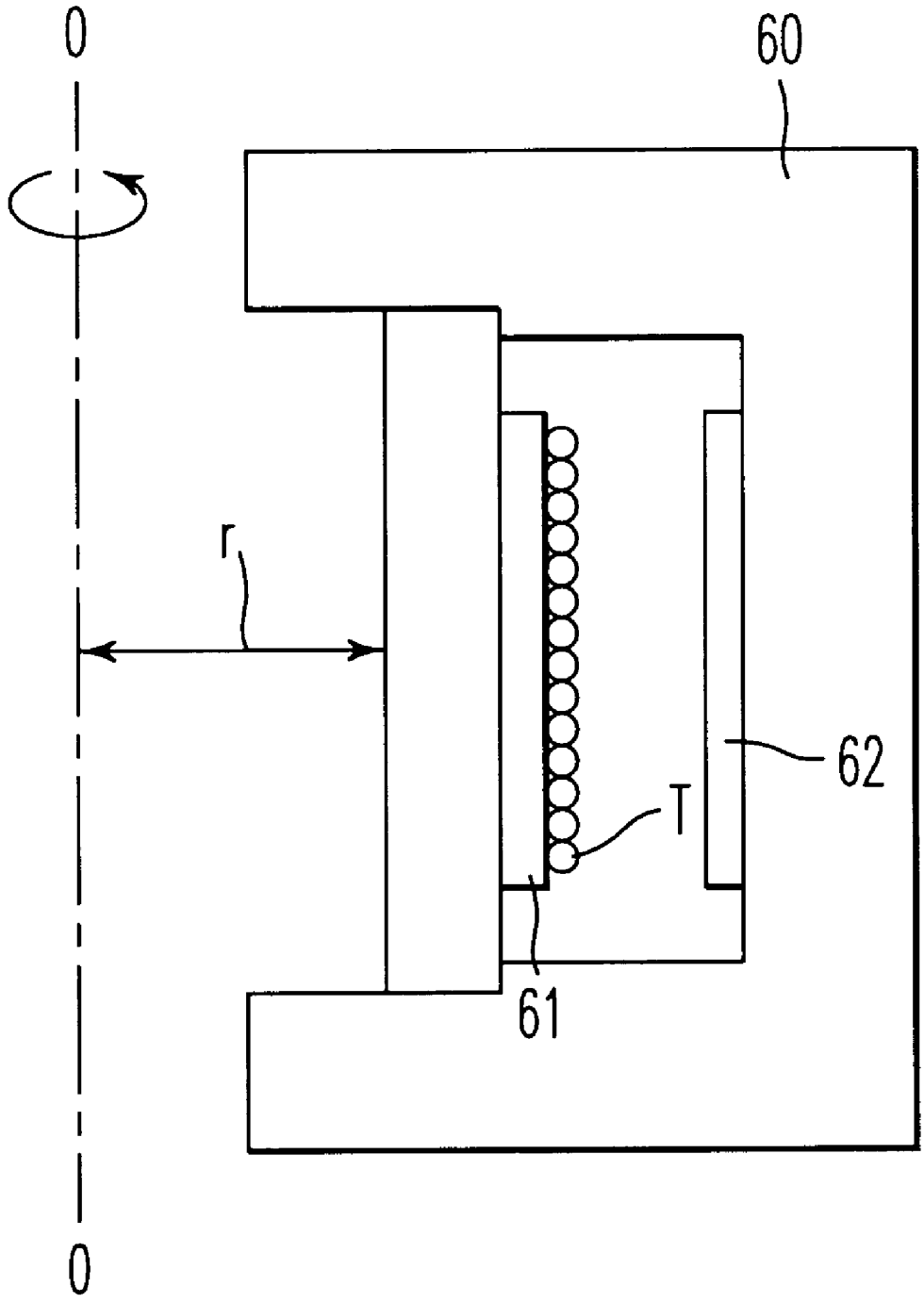
FIG. 5 is a specific illustration showing an arrangement for measuring the adhering force of toner.

As shown in FIG. 5, a sample holder 60 revolves around the axis O—O of a rotor. The sample holder 60 has a bed 61 on which toner T is deposited, and a flat toner catcher 62 outboard of the bed 61. The bed 61 is implemented by the material of the drum 9 or belt 19 on which toner should be deposited. For the toner T, PRETER 550 was used having a particle size of 7.5 μm. The distance r between the axis of rotation O—O and the surface of the bed 61 where the toner T was deposited was 8 cm. When the sample holder 60 revolves around the axis O—O, the toner T flies off the bed 61 with the result that the amount of toner on the bed 61 decreases. The revolution speed of the sample holder 60 was measured when the amount of toner remaining on the bed 61 was reduced to 50%. An adhering force F is expressed as:

$$F=m\cdot r(2\cdot\pi\cdot R) \text{ (unit: N)}$$

where m is the weight of the toner T caught by the catcher 62, R is the above revolution speed of the sample holder 60, and r is the revolution speed of the sample.

Figure 6:
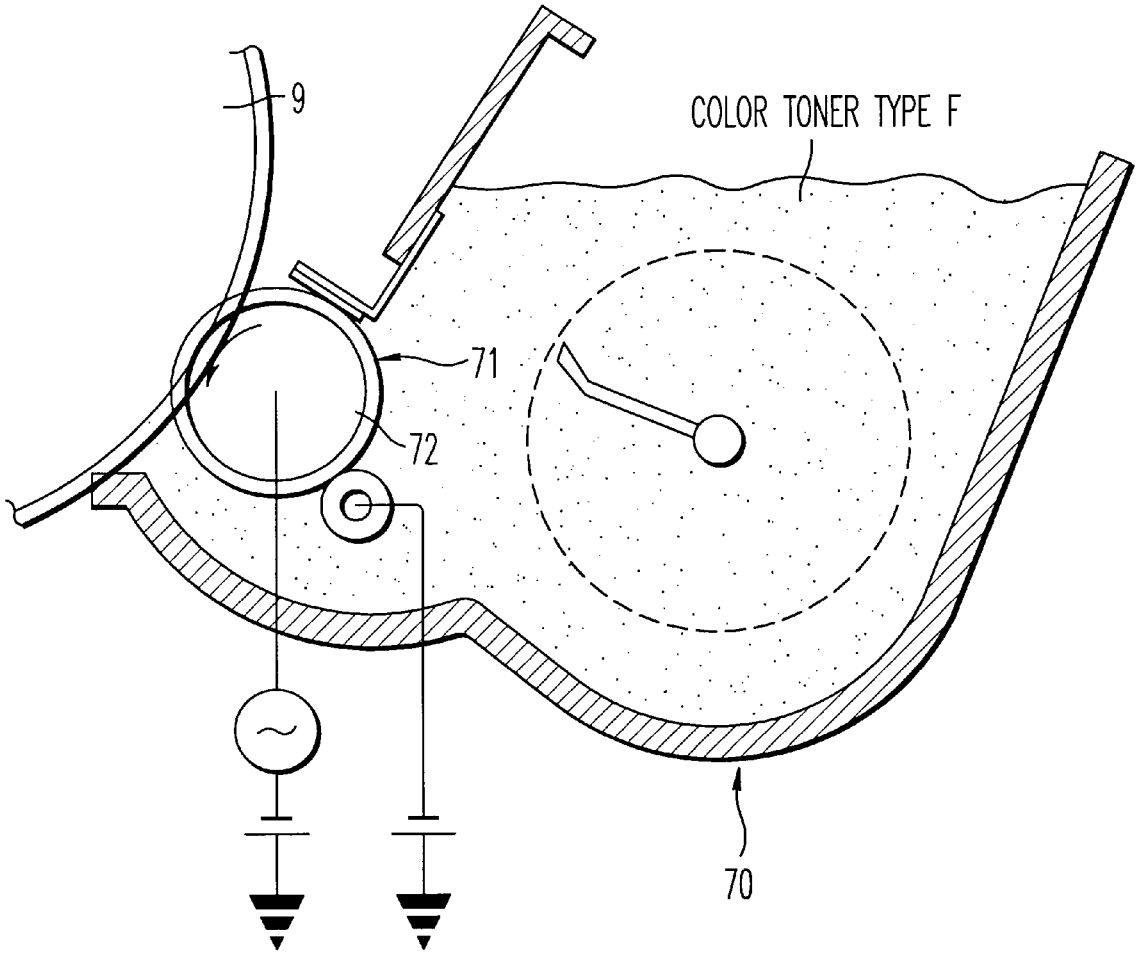
FIG. 6 is a specific illustration showing an arrangement for measuring the frictional charging characteristic.

Further the method of measurement of the frictional charging characteristic will be described hereinafter with reference to FIG. 6.

The coating liquid (material A, B, C, D, E and F) were each applied to respective cores 72 made of stainless steel by spraying such that it would form a 2 mm film when hardened, and toner carriers 71 were made as experimental material. Each toner carrier 71 was mounted to a developing device 70 filled with Ricoh Color Toner Type F (a trade name for toner available from Ricoh Corp.), and an amount of toner charging was measured after the developing device 70 was operated for ten minutes. A charge value, of equal magnitude and opposite polarity of the toner charging, was measured for each material A, B, C, D, E and F.

As a result, the adhering force acting between the toner and the photoconductive drum 9 was measured to be $5.7\times10^{-8}$ N. The results of such experiments are listed in Table 7.

TABLE 7

Fc is the frictional charging characteristic of each material.
$A_D$ is the adhering force acting between the toner and each material in actual operating conditions.

| | A | B | C | D | E | F |
|---|---|---|---|---|---|---|
| Fc (μC/g) | −20.3 | −12.3 | −8.4 | −3.1 | +4.2 | +8.6 |
| Rank | 5 | 5 | 5 | 5 | 2 | 3 |
| $A_D$ (N) | $7.74\times10^{-8}$ | $5.59\times10^{-8}$ | $6.22\times10^{-8}$ | $6.52\times10^{-8}$ | $7.14\times10^{-8}$ | $8.85\times10^{-8}$ |

In Table 7, ranks 5–1 are the same as for Table 1.

As Table 7 indicates, Examples, A, B, C, and D remain in the allowable level as to the fine line hollow, but Examples E and F do not remain in the allowable level as to the fine line hollow. Thus, the fine line hollow is closely related to the frictional charging characteristic of the material.

EXPERIMENT 8

It is possible that the frictional charging characteristic of the intermediate transfer belt may depend on a change in a toner component.

A relation between the frictional charging characteristic of the intermediate transfer belt and the fine line hollow was determined experimentally under the same conditions as for EXPERIMENT 7 except for the component of the toner. In EXPERIMENT 8 a toner was used that included a polarity control agent (tetraphenylborate), where the content was decreased by half as compared with the toner used for EXPERIMENT 7. Further, the adhering force acting between the toner and the photoconductive drum 9 was measured to be $4.2\times10^{-8}$ N. The results of such experiments are listed in Table 8.

TABLE 8

Fc is the frictional charging characteristic of the each material.
$A_D$ is the adhering force acting between the toner and each material in actual operating conditions.

| | A | B | C | D | E | F |
|---|---|---|---|---|---|---|
| Fc ($\mu$C/g) | −11.2 | −6.5 | −1.8 | +4.7 | +10.3 | +16.4 |
| Rank | 5 | 3 | 4 | 2 | 2 | 1 |
| $A_D$ (N) | $6.32 \times 10^{-8}$ | $4.1 \times 10^{-8}$ | $4.83 \times 10^{-8}$ | $5.17 \times 10^{-8}$ | $7.04 \times 10^{-8}$ | $7.36 \times 10^{-8}$ |

In Table 8, ranks 5–1 are the same as for Table 1.

As Table 8 indicates, Examples, A and C, remain in the allowable level as to the fine line hollow, but Examples, B, D, E and F do not remain in the allowable level as to the fine line hollow. For the material B, the adhering force acting (AD) between the toner and the material B was smaller than the adhering force acting between the toner and the photoconductive drum 9 in the actual operating conditions. Namely, in EXPERIMENT 8, the fine line hollow is also closely related to the frictional charging characteristic of the material. When the frictional charging characteristic of the intermediate transfer belt 19, which occurs by friction between the belt 19 and the toner, is a positive polarity, it is possible that the fine line hollow may occur. In other words, when the frictional charging polarity of the toner, which rubs against the intermediate transfer belt 19, is the same polarity as the transfer bias (negative polarity) applied to the belt 19 from the transfer roller 20, the occurrence of the fine line hollow can be controlled.

EXPERIMENT 9

Additional experiments were performed in order to find out the potential for controlling the frictional charging polarity between the intermediate transfer belt 19 and the toner. A relation of the frictional charging characteristic between the belt 19 and the toner was determined by experiments under the same conditions as for EXPERIMENT 8, except for using a third material, when a material for controlling the frictional charging polarity, which is positioned between the belt 19 and the toner. Zinc stearate was used as the third material. As shown in FIG. 1 shown a Zinc stearate applying device was provided with a brush 38 and a flat lubricant 37*a*. Brush 38 applied a flat lubricant 37 of zinc stearate to the belt 19 while a brush roller 10-2 may apply a flat lubricant 39 of zinc stearate to the drum 9 in order to hold the above relation between the adhering force acting of the drum 9 and that of the belt 19. Further, the adhering force acting between the toner and the photoconductive drum 9 was measured to be $6.7\times10^{-8}$ N. The results of such experiments are listed in Table 9 below.

As Table 9 indicates, Examples, A, C and E, remain in the allowable level as to the fine line hollow, but Examples, B, D and F do not remain in the allowable level as to the fine line hollow. Regarding adhering force, AD, for the material B and D, the adhering forces between the toner and the materials were smaller than the adhering force acting between the toner and the photoconductive drum 9 in the actual operating conditions (i.e., $6.7\times10^{-8}$ N). As a result, applying zinc stearate to the belt 19 changes a positive polarity of the material E into a negative polarity, which has the effect of controlling the fine line hollow.

The above-mentioned illustrative embodiments have been explained with values of resistances, materials for the intermediate transfer elements, materials for controlling the frictional charging polarity, a structure with an arrangement of the intermediate transfer element and the electrode. The intermediate transfer element described above is implemented as the intermediate transfer belt 19, although it may be implemented as a roller or a drum, if desired. These, however, are not intended to be limiting and may be altered to match other image forming conditions.

The present document is based on Japanese Patent Application No. 10-32339 filed in Japan on Jan. 30, 1998; and Japanese Patent Application No. 10-375874 filed in Japan on Dec. 21, 1998 the entire contents of both of which being incorporated herein by reference.

Obviously, numerous modifications and variations of the present invention are possible in light of the above teachings. It is therefore to be understood that within the scope of the appended claims, the invention may be practiced otherwise than as specifically described herein.

We claim:

1. An image forming apparatus comprising:

an image carrier configured to hold thereon a developed image;

an intermediate transfer element configured to receive said developed image from said image carrier; and an electrode having a bias of a predetermined polarity to be applied to said intermediate transfer element, said electrode exposing said intermediate transfer element to an electric field, wherein

TABLE 9

Fc is the frictional charging characteristic of each material.
$A_D$ is the adhering force acting between the toner and each material in actual operating conditions.

| | A | B | C | D | E | F |
|---|---|---|---|---|---|---|
| Fc ($\mu$C/g) | −23.1 | −10.8 | −11.3 | −3.5 | −0.8 | +6.7 |
| Rank | 5 | 3 | 5 | 3 | 4 | 1 |
| $A_D$ (N) | $9.80 \times 10^{-8}$ | $3.24 \times 10^{-8}$ | $7.57 \times 10^{-8}$ | $6.07 \times 10^{-8}$ | $8.20 \times 10^{-8}$ | $7.03 \times 10^{-8}$ |

In Table 9, ranks 5–1 are the same as for Table 1.

said intermediate transfer element having a polarity controlling material applied thereto, said intermediate transfer element having an adhering force acting on toner of said developed image that is greater than or equal to an adhering force acting between said toner and said image carrier, said adhering force being at least $5.59 \cdot 10^{-8}$ N; and said adhering force being present as a result of a frictional charging polarity of charge on a portion of said toner having a same polarity as the bias voltage applied to said intermediate transfer element from said electrode, said charge stemming from said toner rubbing against said intermediate transfer element, and said polarity controlling material being configured to change a polarity of another portion of said toner that is of a different polarity than said predetermined polarity.

2. The image forming apparatus as claimed in claim 1, further comprising:

a material disposed between said intermediate transfer element and said toner, a characteristic of said material being to control the frictional charging polarity.

3. The image forming apparatus as claimed in claim 2, further comprising:

an applicator configured to apply said material to said intermediate transfer element.

4. The image forming apparatus as claimed in claim 2, wherein:

said the material being Zinc stearate.

5. The image forming apparatus as claimed in claim 1, wherein:

said intermediate transfer element including at least one of a belt, a roller and a drum.

6. An image forming apparatus comprising:

means for holding a developed image, said developed image comprising toner arranged in a predetermined pattern;

means for receiving said developed image via a primary toner transfer operation, said primary toner transfer operation occurring before a subsequent secondary toner transfer where said developed image is transferred to a sheet said means for receiving including means for controlling a polarity of said toner;

means for exposing said means for receiving to an electric field by applying a bias voltage having a predetermined polarity; and means for maintaining an adhering force of at least $5.59 \cdot 10^{-8}$N between said toner and said means for receiving during said primary toner transfer operation, said adhering force being greater than a corresponding force between said toner and said means for holding, said means for maintaining including means for maintaining a frictional charging polarity of charge on said toner that has a same polarity as said predetermined polarity of said bias voltage.

7. The image forming apparatus as claimed in claim 6, further comprising:

a material disposed between said means for receiving and said toner, a characteristic of said material being to control the frictional charging polarity.

8. The image forming apparatus as claimed in claim 7, further comprising:

means for applying said material to said means for receiving.

9. The image forming apparatus as claimed in claim 7, wherein:

said the material being Zinc stearate.

10. The image forming apparatus as claimed in claim 6, wherein:

said means for receiving including at least one of a belt, a roller and a drum.

* * * * *